United States Patent [19]

Kanter

[11] Patent Number: 4,725,224

[45] Date of Patent: Feb. 16, 1988

[54] DEVICE FOR SUPPLYING AIR TO THE COMBUSTION CHAMBER OF A BOILER FURNACE DESIGNED FOR NORMAL OPERATION WITH NATURAL GAS AND EMERGENCY OPERATION WITH FUEL OIL

[75] Inventor: Maurice Kanter, Chaville, France

[73] Assignee: Stein Industrie, S.A., Velizy Villacoublay, France

[21] Appl. No.: 24,537

[22] Filed: Mar. 11, 1987

[30] Foreign Application Priority Data

Mar. 14, 1986 [FR] France ..... 86 03693

[51] Int. Cl.[4] ..... F23Q 9/00

[52] U.S. Cl. ..... 431/285; 122/479 B

[58] Field of Search ..... 110/187, 188; 431/8, 431/284, 285; 122/479 B

[56] References Cited

U.S. PATENT DOCUMENTS

| | | | |
|---|---|---|---|
| 2,840,053 | 6/1958 | Caracristi | 122/478 |
| 3,269,368 | 8/1966 | McCoy et al. | 122/479 |
| 3,789,804 | 2/1974 | Aguet . | |
| 3,989,443 | 11/1976 | Campbell | 431/285 X |
| 4,003,692 | 1/1977 | Moore | 431/284 X |

FOREIGN PATENT DOCUMENTS

| | | |
|---|---|---|
| 1230512 | 12/1966 | Fed. Rep. of Germany . |
| 1241929 | 6/1967 | Fed. Rep. of Germany . |
| 821423 | 10/1959 | United Kingdom . |
| 852965 | 11/1960 | United Kingdom . |

*Primary Examiner*—Edward G. Favors
*Attorney, Agent, or Firm*—Kenyon & Kenyon

[57] ABSTRACT

A boiler furnace normally used for firing natural gas and designed for temporary operation with an emergency fuel consisting of fuel oil is equipped with a device which makes use of blowers for delivering air to the burners. The device includes in particular an auxiliary blower for delivering a supplemental air flow to the burners while they are being used for firing fuel oil. No provision is made for recycling of flue gases in the flue-gas removal circuit and the burners are preferably of a tiltable type.

3 Claims, 1 Drawing Figure

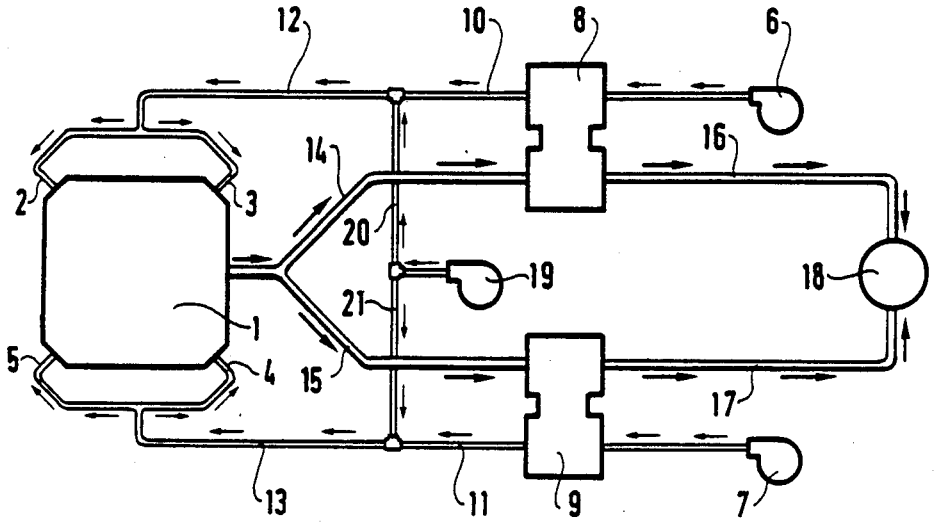
12
10
8
6
14
16
2
3
20
19
18
21
1
5
4
15
17
13
11
9
7

DEVICE FOR SUPPLYING AIR TO THE COMBUSTION CHAMBER OF A BOILER FURNACE DESIGNED FOR NORMAL OPERATION WITH NATURAL GAS AND EMERGENCY OPERATION WITH FUEL OIL

BACKGROUND OF THE INVENTION

1. Field of the Invention

The present invention relates to a device for supplying air to the combustion chamber of a boiler furnace designed for normal operation with natural gas while utilizing forced-draft fans or blowers for delivering air to the burners as well as for temporary operation with an emergency fuel consisting of fuel oil.

When an emergency fuel is employed, devices of this type make it possible to maintain a steam-generating furnace in operation at the cost of a certain reduction of the optimum operating range.

2. Description of the Prior Art

For temporary oil-firing of a furnace combustion chamber designed for normal operation with natural gas, it has already been proposed to make use of blower-type fans for delivering air under a pressure of higher value than that required for normal operation with natural gas and corresponding to the pressure required for oil-firing while also incorporating auxiliary blowers and circuits for recycling flue gases to the combustion chamber by means of these auxiliary blowers. However, this makes it necessary to provide main blowers of unduly large size as well as to instal and maintain at least two auxiliary blowers and heat-insulated recycling ducts. Furthermore, the power consumption of both main and auxiliary blowers in emergency operation is quite considerably higher than the power consumption under normal operating conditions. The installation of these auxiliaries therefore carries a heavy penalty both in capital investment and input power requirements. Moreover, the operation of the combustion chamber is modified since the flame temperature obtained from fuel oil is lower than that of natural gas, with the result that the temperature of the combustion gases at the level of the superheaters and resuperheaters of the boiler furnace is reduced and results in less favorable heat-transfer efficiency.

The object of the present invention is to provide a supply device for temporary operation with fuel oil which does not involve any need for over-dimensioning of the main air blowers, which does not call for the installation of a flue-gas recycling circuit, and which minimizes the additional capital cost and power consumption which correspond to the possibility of emergency operation.

SUMMARY OF THE INVENTION

The device in accordance with the invention is distinguished by the fact that it includes an auxiliary blower for delivering a supplemental air flow to the burners while they are being used for firing fuel oil and that no provision is made for recycling of flue gases in the flue-gas removal circuit.

In addition, the device aforesaid is preferably provided with tiltable burners.

It is preferable to choose main blowers having a maximum air-flow capacity or delivery equal to the value required for natural-gas operation at maximum load and the maximum air-flow capacity of the auxiliary blower corresponds to the quantity of supplemental air to be delivered for fuel-oil operation of the furnace at maximum load.

The discharge outlet of the auxiliary blower is advantageously coupled with both discharge outlets of the main blowers so as to reduce the heating power drop in the event of failure of one of these burners during natural-gas operation.

The tiltable burners permit upward displacement of flame-temperature zones (hot zones) with respect to those which would normally be established during oil-firing with fixed burners, thus making it possible to adjust the temperature of the combustion gases at the level of the boiler superheaters and resuperheaters.

Taking into account the supplemental air flow required for fuel-oil operation, it is sufficient to provide only one additional blower instead of the two blowers which would be necessary for recycling the flue gases. Moreover, the air delivery ducts of the additional blower are ordinary non-insulated ducts instead of the heat-insulated ducts which would be necessary for flue-gas recycling.

BRIEF DESCRIPTION OF THE DRAWINGS

An air supply device designed in accordance with the invention for emergency fuel-oil firing of a natural-gas boiler furnace combustion chamber will be described hereinafter by way of example, reference being made to the single accompanying FIGURE, which is a schematic flow diagram of a furnace supply system.

DETAILED DESCRIPTION OF THE INVENTION

Fuel and combustion air are fed to the corners of the combustion chamber of the boiler furnace 1 via several series of superposed burners 2, 3, 4, 5 in the directions indicated by arrows. The combustion air is delivered by the centrifugal blowers 6, 7 to the recuperator exchangers 8, 9 in which air is heated in contact with material which has previously been heated by the flue gases produced by combustion in the furnace. The heated air then flows on the one hand through heat-insulated pipes 10, 12 and on the other hand through heat-insulated pipes 11, 13 to the series of burners 2, 3 and 4, 5 respectively, whereupon said heated air produces combustion of natural gas under normal operating conditions, the gas being supplied through conduits which are not shown in the FIGURE.

The aforementioned burners can be tilted upward in order to permit compensation for part of the reduction in temperature of the combustion gases at the level of the superheaters and resuperheaters of the boiler furnace as a result of substitution of fuel oil for natural gas.

The flue gases discharged from the combustion chamber, superheater exchanger and resuperheater exchanger are returned via the ducts 14 and 15 to the recuperator exchangers 8 and 9 in which they yield part of their sensible heat, then pass through the ducts 16 and 17 to the stack 18.

In the case of emergency operation with fuel oil, the auxiliary centrifugal blower 19 is started-up and delivers the supplemental cold air required for combustion of fuel oil, on the one hand via the pipe 20 into the pipe 12 and on the other hand via the pipe 21 into the pipe 13.

The main blowers 6 and 7 are so dimensioned that each blower delivers 50% of the total flow corresponding to operation of the furnace at its rated capacity, that is to say at full power.

The auxiliary blower is so dimensioned as to deliver, for example, approximately 20% of the total flow corresponding to operation at the rated capacity. Should one of the main blowers fail during normal operation with natural gas, operation of the furnace at 70% of maximum power can thus be guaranteed. In an installation designed for emergency service by flue-gas recycling, it would have been necessary to overdimension each main blower. Thus each blower would have been capable of producing approximately 60% of the total flow corresponding to operation at rated capacity and the power attained in the event of failure of one of the blowers would therefore have been only 60% of the rated power.

What is claimed is:

1. A device for supplying air to the combustion chamber of a boiler furnace designed for normal operation with natural gas while utilizing at least two main blowers having discharge outlets for delivering air to the burners as well as for temporary operation with an emergency fuel consisting of fuel oil, wherein said device includes an auxiliary blower having a discharge outlet for delivering a supplemental air flow to the burners while they are being used for firing fuel oil, and wherein no provision is made for recycling of flue gases in the flue-gas removal circuit, and wherein the discharge outlet of the auxilary blower is coupled with both discharge outlets of the main blowers so as to reduce the heating power drop in the event of failure of one of said main blowers during natural gas operation of the furnace.

2. A device according to claim 1, wherein said device is further provided with tiltable burners.

3. A device according to claim 1, wherein the maximum air-flow capacity of the main blowers is equal to the flow capacity required for natural-gas operation at maximum load, and wherein the maximum air-flow capacity of the auxiliary blower corresponds to the quantity of supplemental air to be delivered for fuel-oil operation of the furnace at maximum load.

* * * * *